US006349655B1

(12) United States Patent
Carr et al.

(10) Patent No.: US 6,349,655 B1
(45) Date of Patent: Feb. 26, 2002

(54) WIRE MANAGEMENT SYSTEM

(75) Inventors: Roger J. Carr, Shirley Croydon; Ben Fether, London, both of (GB)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 09/574,064

(22) Filed: May 18, 2000

(51) Int. Cl.[7] ..... A47B 37/00
(52) U.S. Cl. ..... 108/50.02
(58) Field of Search ..... 108/50.02, 50.01, 108/50.11, 23; 312/223.1, 223.6

(56) References Cited

U.S. PATENT DOCUMENTS

| | | | | | |
|---|---|---|---|---|---|
| 4,094,561 | A | * | 6/1978 | Wolff et al. | 312/223.6 |
| 4,372,629 | A | * | 2/1983 | Propst et al. | 312/223.6 |
| 4,500,150 | A | | 2/1985 | Leibensperger et al. | |
| 4,535,703 | A | * | 8/1985 | Henriott et al. | 312/223.6 X |
| 4,948,205 | A | * | 8/1990 | Kelley | 312/223.6 X |
| 5,103,741 | A | * | 4/1992 | Grund et al. | 312/223.6 X |
| 5,144,896 | A | | 9/1992 | Fortsch et al. | |
| 5,272,988 | A | | 12/1993 | Kelley et al. | |
| 5,277,131 | A | | 1/1994 | Fortsch | |
| 5,451,101 | A | | 9/1995 | Ellison et al. | |
| 5,473,994 | A | | 12/1995 | Foley et al. | |
| 5,640,912 | A | | 6/1997 | Diffrient | |
| 5,901,513 | A | * | 5/1999 | Mollenkopf et al. | 108/50.02 X |
| 5,971,508 | A | * | 10/1999 | Deimen et al. | 312/223.6 |
| 5,994,644 | A | * | 11/1999 | Rindoks et al. | 312/223.6 X |

* cited by examiner

*Primary Examiner*—Jose V. Chen
(74) *Attorney, Agent, or Firm*—Jones, Day, Reavis & Pogue

(57) ABSTRACT

A wire management device for routing wires and cables underneath a work surface includes a plurality of body members having arms extending therefrom, the distal ends of which are slidingly connected to a flexible skirt. The body members and arms are configured to support the skirt such that a free edge of the skirt is in close proximity with a bottom surface of the work surface. Cables or wires may be inserted into the device by deflecting the flexible skirt whereupon the cables or wires can be supported underneath the work surface on the arms and routed to any desired location. The device thus allows for convenient wire routing and is particularly effective in permitting reconfiguration of furniture components.

11 Claims, 2 Drawing Sheets

WIRE MANAGEMENT SYSTEM

BACKGROUND OF THE INVENTION

1. Field of the Invention

The present invention relates generally to the construction of furniture such as desks, tables, credenzas and the like and, more particularly, to office furniture having a wire management system capable of routing and concealing various wires and cables associated with electrical equipment supported on a furniture work surface.

2. Description of the Related Art

Increasingly, office furniture has been designed to support electrically operated equipment of various types such as telephones, typewriters, computer terminals, facsimile machines, calculators and the like as the office environment has become more automated. Such devices invariably have electrical cords, cables, and wires associated therewith which typically connect to receptacles provided in an adjacent wall or modular panel assembly. Unless provisions are made to efficiently route the wires or the like interiorly of the furniture component structure, a cluttered and inefficient work environment will result which also detracts significantly form the aesthetic appearance of the furniture and work space.

Various wire management systems have been proposed including, for example, access openings to vertical panels of the furniture and in the work surface. Also proposed are elongated wiring channels or troughs which run the length or width of the furniture and within which the wires and the like can be routed. Examples of wire management systems for office furniture are disclosed in U.S. Pat. Nos. 4,535,703, 5,144,896 and 5,451,101.

While current forms of wire management systems improve the efficiency of routing and concealing electrical cords, cable and the like, it is desirable to provide yet an improved system which is convenient to install, even on existing furniture, which is highly functional and convenient in terms of routing the wires and which is cost-effective to produce.

SUMMARY OF THE INVENTION

The present invention improves over the prior art by providing a wire management device for routing wires and cables underneath a work surface including a plurality of body members having arms extending therefrom, the distal ends of which are slidingly connected to a flexible skirt. The body members and arms are configured to support the skirt such that a free edge of the skirt is in close proximity with a bottom surface of the work surface. Cables or wires may be inserted into the device by deflecting the flexible skirt whereupon the cables or wires can be supported underneath the work surface on the arms and routed to any desired location. The device thus allows for convenience wire routing and is particularly effective in permitting reconfiguration of furniture components.

BRIEF DESCRIPTION OF THE DRAWINGS

The foregoing and other novel improvements and advantages of the invention will be better understood upon a reading of the following detailed description taken in conjunction with the accompanying drawings wherein.

DETAILED DESCRIPTION OF THE PREFERRED EMBODIMENT

Figure 1:
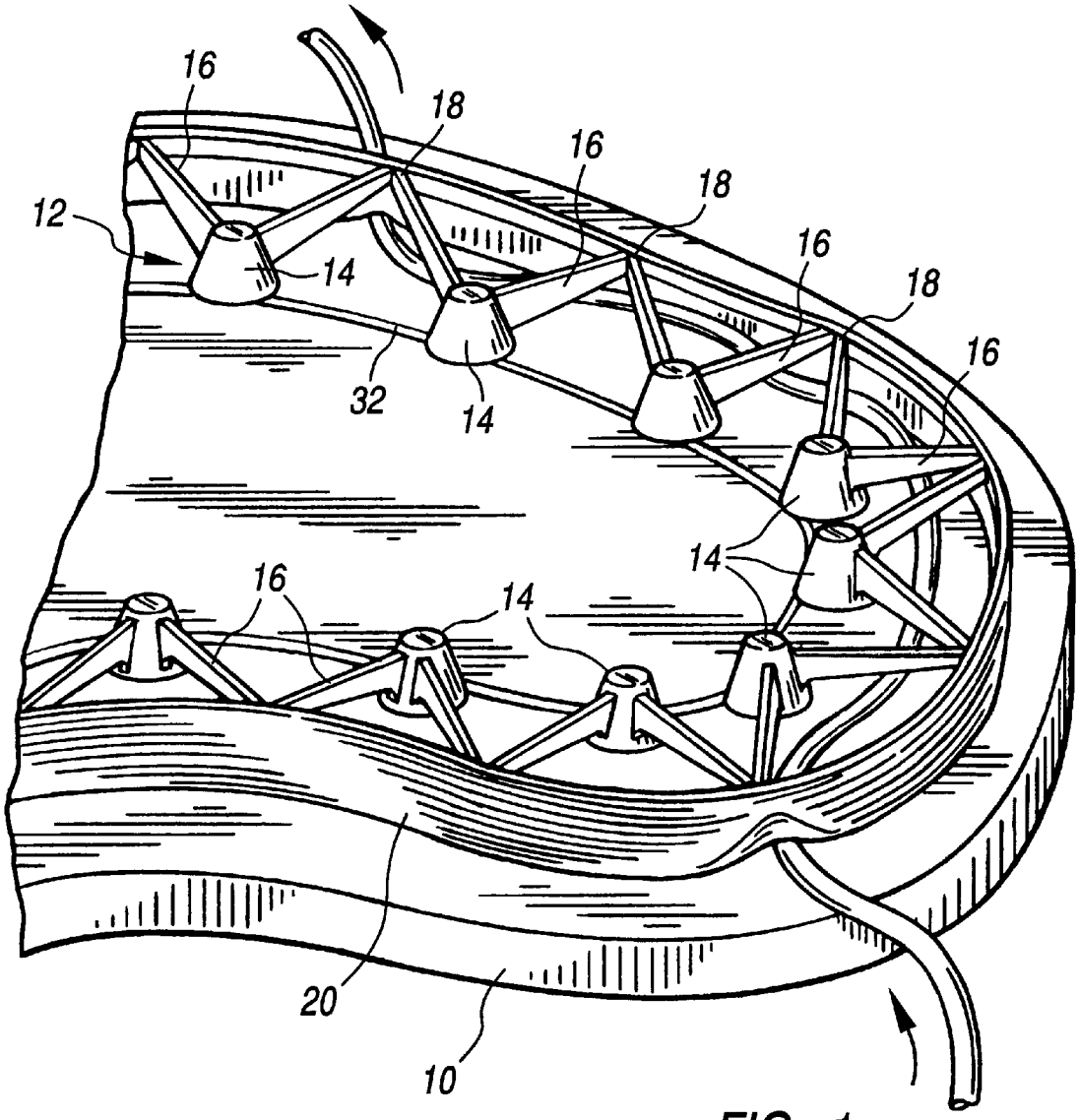
FIG. 1 is a partial perspective view of the underside of a work surface having a wire management device constructed according to the principles of the invention installed thereon.

Referring now to the drawings, and initially to FIG. 1, a wire management system constructed according to the invention is shown as installed on the underside of a work surface 10. The system is designated generally by the reference numeral 12 and includes as its principal components a plurality of knob-like body members 14 each having a pair of arms 16 extending radially outwardly therefrom. The body members 14 and arms 16 are preferably injection molded as unitary structures from a suitable thermoplastic material. The pairs of arms 16 are constructed to form an acute angle preferably approaching ninety degrees. Connected to distal ends 18 of the arms, in a manner which will be described in detail hereinafter, is a generally elongate flexible skirt 20.

Figure 2:
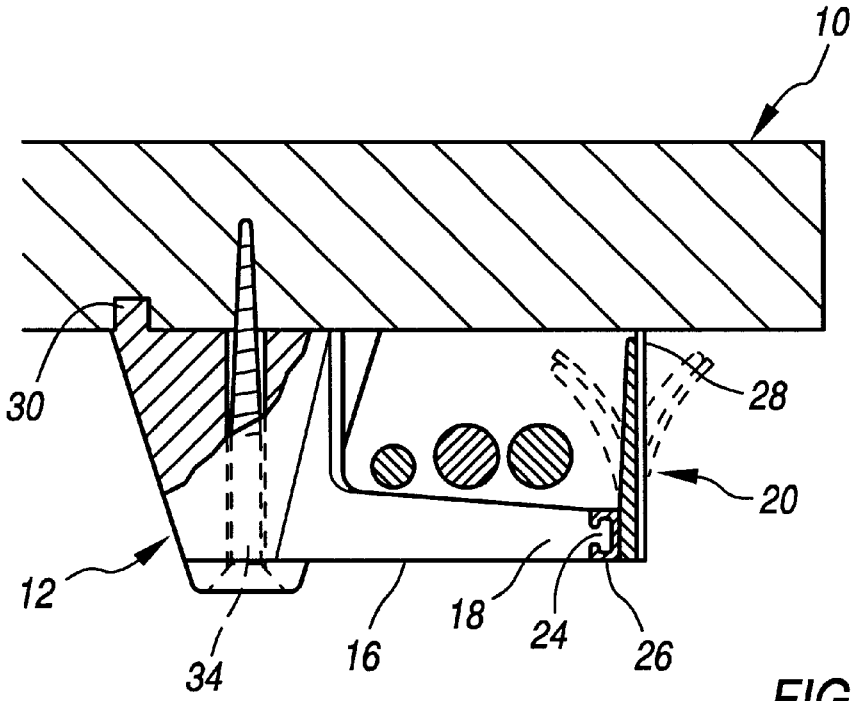
FIG. 2 is a side cross-sectional view illustrating a portion of the wire management device as supporting cables beneath the work surface.

Turning now to FIG. 2, a side cross-sectional view of the system 12 is shown wherein cables 22 are illustrated as supported under the work surface 10 by an arm 16. In this view, the skirt 20 can be seen as connected to the arms 16 by a generally T-shaped projection 24 formed on the distal ends 18 of the arms 16 which cooperates with a channel portion 26 formed integrally with the skirt 20 for slidable adjustable attachment of the skirt 20 to the arms 16. The skirt 20 is preferably dimensioned to have a free end 28 disposed in close proximity to the work surface 10 when the system 12 is installed. For ease of assembly, each body member 14 is formed with a projection 30 which is suitably dimensioned to be received in a slot 32 formed in the underside of the work surface 10. (See FIG. 1.) The body members 14 may be secured to the work surface 10 by suitable screws 34.

Figure 3:
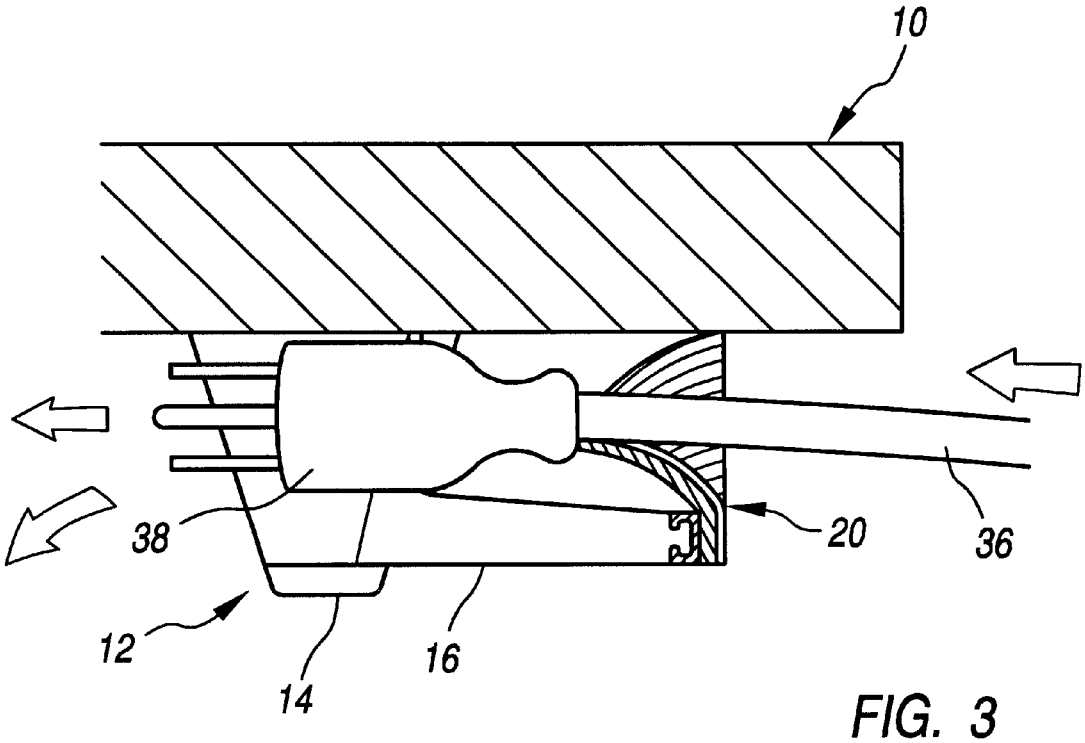
FIG. 3 is a side cross-sectional view of a portion of the wire management device illustrating its use with an electrical cord inserted from the front of the work surface.

Referring to FIG. 3, the system 12 is shown as accommodating an electrical cord 36 having a plug 38 at its end. The plug 38 can simply be inserted under the work surface 10 causing the skirt 20 to deflect as illustrated. The cables 36 may then be routed along the inside of the skirt 20 supported by the arms 14 as shown in FIGS. 1 and 2. Alternatively, the cable 36 may be directed to the left, as viewed in FIG. 3, whereupon it may be plugged into a suitable receptacle, for example.

The advantages of the system 12 can now be appreciated. The system 12 allows for a continuous cableway to be created, with little depth, around every work surface perimeter, whether it is straight, curved or round. The cables can be fed into the cableway from the front, which is masked by the skirt 20, or from below. The cables can also exit at virtually any location. A cable, for example, can exit directly through the front of the skirt 20 wherever desired. Installation and routing of cables can be conveniently done from the outside of the work surface simply by running one's hand along the skirt 20. Reconfiguration of furniture is also conveniently performed. Because of the adjustable means for attaching the skirt 20 to the arms 16, the system may be conveniently installed on virtually any shape of work surface, including a curved work surface, by manually sliding the skirt 20 relative to the arms 16 to form a desired shape. A further advantage is that the projection of the body members 14 form the underside of the work surface allows work surfaces to be stacked before installation without damage to the upper surfaces thereof.

While the present invention has been described in connection with a preferred embodiment thereof, it will be apparent to those skilled in the art that many changes and modifications may be made without departing from the true spirit and scope of the invention. Accordingly, it is intended by the appended claims to cover all such changes and modifications as come within the spirit and scope of the invention.

What is claimed is:

1. A wire management device for routing wires and cables underneath a work surface comprising:

a plurality of body members each having a pair of arms extending therefrom at an acute angle to one another;

a skirt formed of flexible material;

means for attaching the skirt to the arms;

wherein said body members and arms are configured to support said skirt such that a free edge of said skirt is in close proximity with a bottom surface of a work surface to receive wires and cables inserted between said free edge and bottom surface.

2. The device of claim 1 wherein said skirt is supportable substantially at right angles to said work surface.

3. The device of claim 1 wherein said arms are configured to be spaced from said bottom surface to thereby support wires or cables beneath said work surface.

4. The device of claim 1 wherein said means for attaching the skirt provides for slidable movement of said strip relative to said arms.

5. The device of claim 1 wherein said body members include projecting means configured to be received in a skirt formed in said bottom surface.

6. A wire management device for attachment to an underside of a work surface and operable to route wires and cables beneath the work surface, the device comprising:

a plurality of body members each having a pair of arms extending therefrom;

a skirt formed of flexible material operatively connected to distal ends of said arms;

wherein said arms are supportable by said body members in spaced parallel relationship to said underside of said work surface with a free edge of said skirt in close proximity with said work surface such that wires or cables can be inserted over said skirt and be supported by said arms.

7. A furniture component for use in an office environment comprising:

a generally planar work surface for supporting electrically operated equipment thereon and having a generally planar underside surface;

a plurality of body members each attached to said underside surface in spaced relationship one to another;

a pair of arms extending from each body member in parallel spaced relationship to said underside surface; and a flexible generally elongate skirt connected to distal ends of the arms and having an upper free edge disposed in close proximity to said underside surface.

8. The furniture component of claim 7 wherein said skirt is supported by said arms substantially at right angles to said underside surface.

9. The furniture component of claim 7 wherein said arms of each pair extend at an acute angle to one another.

10. The furniture component of claim 7 wherein said skirt is slidably connected to said arms.

11. The furniture component of claim 7 wherein said underside surface includes a slot and said body members are each provided with a projection which is received by said slot.

* * * * *